United States Patent [19]

Finn

[11] 4,274,312

[45] Jun. 23, 1981

[54] TOGGLE WRENCH

[76] Inventor: Kenneth F. Finn, R.R. Box 468, Macomb, Ill. 61455

[21] Appl. No.: 62,479

[22] Filed: Jul. 31, 1979

[51] Int. Cl.[3] ..... B25B 7/04

[52] U.S. Cl. ..... 81/356

[58] Field of Search ..... 81/352, 353, 354, 355, 81/356, 357, 363, 362, 367-380

[56] References Cited

U.S. PATENT DOCUMENTS

| | | | |
|---|---|---|---|
| 514,752 | 2/1894 | Humphrey | 81/356 |
| 578,249 | 3/1897 | Letteer | 81/356 |
| 2,417,013 | 3/1947 | Petersen | 81/356 |
| 2,481,866 | 9/1949 | Petersen | 81/356 |
| 3,340,754 | 9/1967 | Burchett | 81/356 |

*Primary Examiner*—James L. Jones, Jr.
*Attorney, Agent, or Firm*—Hiram A. Sturges

[57] ABSTRACT

A parallel jaw action toggle wrench comprising a first jaw rigidly fixed to a first handle by means of a track section, a second jaw opposite the first jaw and slidable on the track section, and pivotally connected to a second handle, a toggle link connected to the second handle rearwardly of the first jaw, a connector pivotally attached to the rearward end of the toggle link and moveable along the first handle and a threaded assembly mounted on the first handle and having an adjustment portion, the threaded assembly being so operatively correlated with respect to the connector that operation of said adjustment portion will cause the connector to move lengthwise of the first handle.

13 Claims, 5 Drawing Figures

TOGGLE WRENCH

BACKGROUND OF THE INVENTION

In the past proposals have been made for parallel action toggle wrenches and one of these is shown in the 1967 patent to Burchett, but no provision is made therein for the varying of maximum pressure.

It is an object of this invention to provide not only for adjustment of the size of jaw opening at times when the handles are drawn together and the toggle fully pressured, but also for the adjustment of the amount of maximum pressure to be applied on an object.

At the present time toggle pliers are popular on the market, but not toggle wrenches. A toggle pliers has jaws, the compression surfaces of which are almost always disposed at an angle to each other, and not in parallelism. Bolt heads and nuts all have flat surfaces, between which there are corners which can become chewed off when toggle pliers are used, until they are unfit to be worked with by means of a wrench.

A wrench without a means for applying pressure between its jaws likewise tends to round the corners of another bolt because of the lack of tight fit of the wrench against another bolt.

It is very important that there be made available a concept of a wrench, the compression surfaces of the jaws of which are parallel at all times, but that also has means for applying substantial pressure on a nut or bolt to prevent the jaws from slipping around the corners of a nut or bolt.

SUMMARY

A main objective hereof is to provide a parallel jaw action toggle wrench comprising a first jaw rigidly fixed to a first handle by means of a track section therebetween, a second jaw opposite the first jaw and slidable along the track section, and pivotally connected to a second handle, a toggle link connected to the second handle rearwardly of the first jaw, a connector pivotally attached to the rearward end of the toggle link and movable along the first handle and a threaded assembly mounted on the first handle and having an adjustment portion, the threaded assembly being so operatively correlated with respect to the connector that operation of said adjustment portion will cause the connector to move lengthwise of the first handle.

Another goal hereof is to provide the wrench described with a threaded assembly so constructed that manipulation of its adjustment portion will cause the connector to move not only forward but rearward.

Still another goal is to provide an economy of construction by providing a first externally threaded tube, easily made in an automatic screw machine and rigidly fixed to the first handle and serving to mount the threaded assembly to avoid necessity of threading a handle itself.

Yet another goal is to provide a strong slotted track section which can be drop-forged at the same time as one handle and first jaw, and grooved moving second jaw receiving the trackway to maintain jaw compression surface in parallelism.

DESCRIPTION OF THE PREFERRED EMBODIMENT

Figure 1:
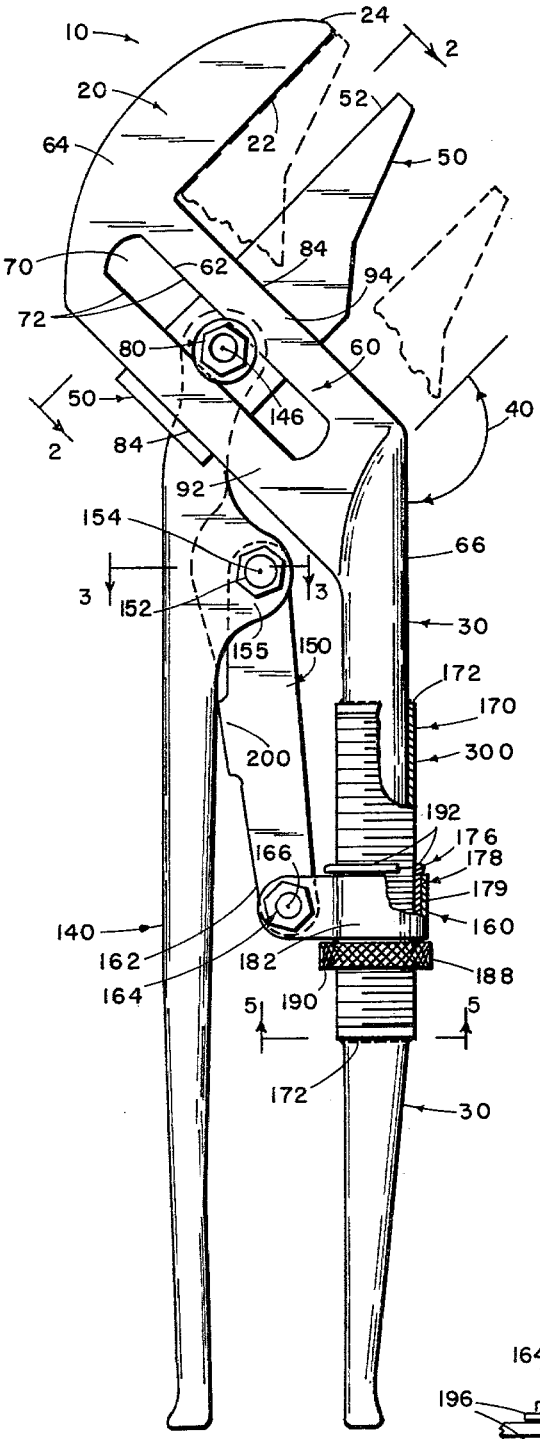
FIG. 1 is a top plan view of the wrench of this invention, shown with parts in full line positions at minimum jaw opening for the chosen position of toggle setting. Maximum opening and completely closed positions of a moveable jaw are partially shown in dotted lines, portions of a connector and of a threaded positioner are broken away.

The parallel jaw action toggle wrench of this invention is generally indicated at 10 in FIG. 1 and has a first jaw 20, having a first compression surface 22 lying in and defining a first plane.

The first jaw has a terminal end 24. A first elongated handle 30 extends rearwardly and away from the terminal end 24, which latter represents the forward end of the wrench 10.

As seen in FIG. 1, the first elongated handle 30 extends substantially in a direction at an obtuse angle 40 with respect to the first compression surface 22 and to the plane in which the first compression surface 22 lies.

The obtuse angle 40 is preferably approximately 135° but can be between 155° and 115°.

A second jaw 50 has a second compression surface 52, lying substantially in a second plane parallel to the first plane 22.

A track section 60 having a track 62 thereon interconnects an inner end 64 of the first jaw 20, and the forward end 66 of the first handle 30.

The track 62 is a straight track formed by a slot 70, having parallel side walls 72, each disposed at a right angle to the first compression surface 22.

A second jaw 50 has a track follower assembly thereon, generally indicated at 80, comprising a pair of grooves 84 extending into one side 86 of the second or movable jaw 50.

The grooves 84 are elongated and with straight side walls for receiving therein respectively those elongated parts 92 and 94 of the track section 60 which are disposed on each side of the slot 70.

The parts 92 and 94 are substantially rectangular shape in cross section along the slot 70 and the grooves 84 are likewise rectangular in cross section and extend through the second jaw 50 from the rearward to the forward side thereof.

The track follower assembly 80 further comprises a bolt 100, having a head 102 at one end and a nut 104 on its other end.

Figure 2:
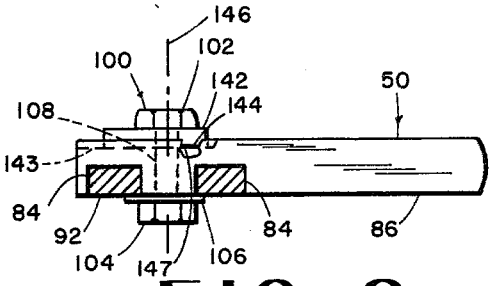
FIG. 2 is a sectional view taken along the line 2—2 of FIG. 1, and showing only a moveable jaw and a track section.
Figure 3:
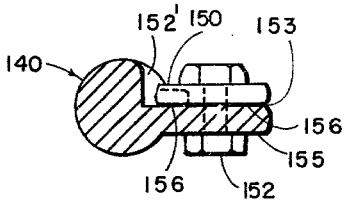
FIG. 3 is a sectional view taken along the line 3—3 but not showing rearward parts of the toggle link.

The nut 104 has a washer 106 thereunder, as best seen in FIG. 2, which latter rests against a portion 108 of the second jaw 50; the portion 108 disposed between the grooves 84.

The washer 106 extends beyond the portion 108 and across the outer side of the side portions 92 and 94 of the track section 60, whereby it has the effect of securing the track section 60 and the second jaw 50 together in cooperation with the bolt 100 to provide a sliding connection between the second or moveable jaw 50 and the track section 60.

The track follower assembly 80 always maintains the second jaws' compression surface 52 in parallelism with the first compression surface 22.

A second elongated handle 140 is pivotally attached to the second jaw 50 by means of providing the second handle 140 with a relatively thin forward end portion 142, received under the bolt head 102, as best seen in FIG. 2, the portion 142 having the bolt 100 extending therethrough for the pivoting of the second handle 140 about a forward axis 146.

The forward axis 146 is disposed parallel to the first plane in which lies the first compression surface 22, and the forward axis 146 is at a right angle to the elongation of the track 62.

The thinner handle portion 142 has a flat surface 147 disposed against the flat bottom surface 144 of a groove 143 in the second jaw 50. The surfaces 144 and 147 are at right angles to the axis 146.

The second handle 140 extends away from the forward axis 146 in a direction substantially at a right angle to the forward axis 146 and rearwardly so at times can be disposed substantially alongside the first handle 30 and parallel therewith.

A toggle link 150 is pivotally attached to the second handle 140 by means of a second bolt assembly 152 for the rotation of the second handle 140 about an intermediate axis 154, disposed in parallelism with and rearwardly of the forward axis 146.

The toggle link 150 has a flat side 153 received against a flat surface 156 of a protruding ear 155 of the second handle 140 on that inner side thereof which faces the first handle 30.

The second handle 140 has a notch 152' receiving the link 150.

A moving connector 160 is movably attached to the first handle 30, as later explained, and the connector 160 is adapted to move forwardly and rearwardly lengthwise of the first handle 30 toward and away from the track section 60.

The rearward end 162 of the toggle link 150 is pivotally attached by means of a rearward bolt assembly 164 to the connector 160 for the pivoting of the toggle link 150 with respect to the connector 160 about a rearward axis 166 parallel to the intermediate axis 154.

A first threaded member or tube 170 extends around the handle 30 adjacent to the rearward axis 166, and extends forwardly and rearwardly therefrom and forwardly and rearwardly of the connector 160.

The tube 170 is threaded on its outer side and is fixed to the handle in any suitable manner such as welding at its ends at 172. It receives thereon a second threaded member 176, having internal threads engaged with the external threads of the first threaded member 170. The second threaded member 176 has a recess 178 around its exterior, the recess having a cylindrical inner wall, against which an engagement portion 182 of the connector 160 is slidably received. The engagement portion 182 has an inner side which is slidably engaged with the inner wall 179 of the recess 178.

The engagement portion 182 engages a majority of the outer surface of the recess wall 179 in a slidable manner, whereby the second threaded member 176 is free to rotate with respect to the connector 160 at times when the second threaded member 176 is manually rotated by engaging a finger rotable roughened surface 188 on the outer side of a rearward ridge 190 of the second threaded member 176. The rearward ridge 190 extends outwardly so as to lap the rearward side of the connector 160 to keep it positioned always on the second threaded member 176.

A forward ridge 192 laps the forward side of the connector 160, preventing the connector from moving forwardly off of the second threaded member 176.

The connector 160 has perforated ears 196, through which the bolt assembly 156 extends, and the toggle link 150 is secured to the ears 196 and can be secured between the ears 196.

Referring now to FIG. 1, a protruding portion 200 of the toggle link 150 extends from the toggle link on the side thereof adjacent to the second handle 140 for the purpose of engaging the second handle 140.

When the engaging portion 200 is in the position for engaging the second handle 140, as shown in FIG. 1, the intermediate axis 154 is disposed either on a line disposed between the forward axis 146 and the rearward axis 166 for locking the wrench on an object, or very slightly toward the handle 30 across such a line, the latter way being shown in FIG. 1.

Figure 4:
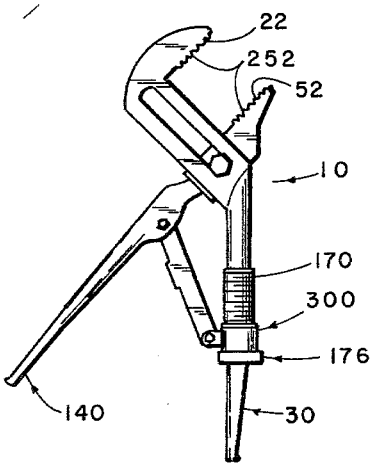
FIG. 4 is a view similar to FIG. 1, but showing the jaws in a position of maximum opening, and the toggle in the position of maximum release, and also showing a modification to illustrate that the jaws could be provided with teeth, if desired.
Figure 5:
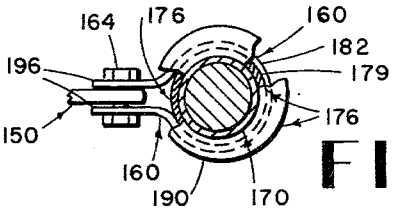
FIG. 5 is a sectional view taken along the line 5—5 of FIG. 1, but showing only a rearward end portion of a toggle link, a connector, a threaded positioner, and a stationary handle.

Referring to FIG. 4, the wrench of FIG. 1 has been modified to show teeth 252 on the respective jaws 22 and 52, which is optional, but which does not interfere with the general description, to the effect that the compression surfaces 22 and 52 are nevertheless substantially each in a respective plane.

In operation the amount of opening of the jaws can be determined by backing off the second threaded member 176 along the first threaded member 170 until a rearward position is assumed, as shown in FIG. 4, in which if the second handle 140 is moved a maximum distance from the first handle 30, the jaws will be at a maximum opening. Any closing of the jaws from that position will move the intermediate axis 154 closer to a plane between the forward and rearward axis 146, and 166, increasing the closing of the jaws and ultimately increasing the pressure on any object disposed therebetween.

The provision of the forward and rearward ridges 188 and 192 maintains a connector at all times, positionable by manipulation of the roughened surface 190.

I claim:

1. A toggle wrench comprising a first jaw having a first compression surface on a rearward side thereof and disposed substantially in a first plane and having a terminal end, first elongated handle extending rearwardly in a direction at an obtuse angle with respect to said first compression surface, a second jaw having a second compression surface disposed substantially in a second plane parallel to said first plane, a track section interconnecting an inner end of said first jaw and the forward end of said first handle, said track section having an elongated track extending at a right angle to and substantially rearwardly from said first compression surface, said second jaw having track follower means thereon cooperatively correlated with said track section and slidably secured to said track section in a manner permitting said second jaw to slide along said track section toward and away from said first jaw while said second compression surface is always maintained in substantial parallelism with said first compression surface, a second elongated handle, means pivotally attaching said second handle to said second jaw in a manner for the pivoting of said second handle about a forward axis disposed parallel to said first plane and at a right angle to the elongation of said track, said second handle extending away from said forward axis in a direction at sugstantially a right angle to said forward axis and at times in directions alongside said first handle, a toggle link pivotally attached to said second handle for rotation about an intermediate axis disposed in parallelism with said forward axis, a connector, means pivotally attaching said connector to said toggle link for pivoting of said toggle link with respect to said connector about a rearward axis parallel to and rearwardly of said intermediate axis, a first threaded means extending around and along said first handle and attached to said first handle, a second threaded means threadedly engaged with said first threaded means whereby rotation in each of two opposite directions of said first and second threaded means with respect to each other will cause said second threaded means to move in opposite directions forwardly and rearwardly along said first handle, said connector being operably attached to said second threaded means so that as said second threaded means moves in said opposite directions along said first handle said rearward axis will move toward and away from said track section.

2. The toggle wrench of claim 1 having said second threaded means having two ridges and having a circumferential recess therebetween receiving said connector thereon, said ridges lapping forward and rearward ends of said connector respectively whereby said connector is restrained to move forwardly and rearwardly as said second threaded means moves forwardly and rearwardly.

3. The toggle wrench of claim 1 having said first threaded means comprising a tube having a threaded exterior and fixed to said first handle, said second threaded means being internally threaded and surrounding said first threaded means and threadedly engaged therewith.

4. A toggle wrench comprising a first jaw, a first elongated handle extending rearwardly from said first jaw, said first jaw having a first compression surface on a rearward side thereof and transverse to the elongation of said first handle, said first jaw having a terminal end, a second jaw having a second compression surface, said first and second compression surfaces extending transversely of said first handle, a track section having an elongated track connecting said first jaw and said first handle, said elongated track extending transversely to said compression surfaces, a second elongated handle alongside said first handle, mounting means comprising the shape of said track section and cooperative shapes of said track section and said second jaw for slidably attaching said second jaw to said track section and for pivotally attaching said second handle to said second jaw, said mounting means comprising said second jaw having track follower means thereon cooperatively correlated with said track section and slidably secured to said track section in a manner permitting said second jaw to slide along said track section toward and away from said first jaw while said second jaw's second compression surface is always maintained transverse to the elongation of said first handle and opposite said first compression surface, said mounting means pivotally attaching said second handle to said second jaw in a manner for the pivoting of said second handle about a forward axis disposed transversely to the elongation of said first handle, a toggle link pivotally attached to said second handle for rotation about an intermediate axis disposed in parallelism with said forward axis, a connector pivotally attached to the rearward end of said toggle link for the pivoting of said toggle link with respect to said connector about a rearward axis parallel to and rearwardly of said intermediate axis, said connector being movable along said first handle, a threaded assembly mounted on said first handle and having a manually rotatable adjustment portion, said threaded assembly being so operatively correlated with respect to said connector that rotation of said adjustment portion will cause said connector to move lengthwise of said first handle, said threaded assembly comprising a first threaded means extending around and along said first handle and attached to said first handle, a second threaded means threadedly engaged with said first threaded means whereby rotation in each of two opposite directions of said first and second threaded means with respect to each other will cause said second threaded means to move in opposite directions forwardly and rearwardly along said first handle, said rearward axis being disposed farther rearwardly than said intermediate axis, said connector being operably attached to said second threaded means so that as said second threaded means moves in said opposite directions said rearward axis will move toward and away from said track section.

5. The toggle wrench of claim 4 having said second threaded means having two ridges and having a circumferential recess therebetween receiving said connector thereon, said ridges lapping forward and rearward ends of said connector respectively whereby said connector is restrained to move forwardly and rearwardly as said second threaded means moves forwardly and rearwardly.

6. The toggle wrench of claim 4 having said first threaded means comprising a tube having a threaded exterior and fixed to said first handle, said second threaded means being internally threaded and surrounding said first threaded means and threadedly engaged therewith.

7. The toggle wrench of claim 5 having said first threaded means comprising a tube having a threaded exterior and fixed to said first handle, said second threaded means being internally threaded and surrounding said first threaded means and threadedly engaged therewith.

8. The toggle wrench of claim 7 having said first elongated handle extending substantially in a direction at an obtuse angle with respect to said first compression surface.

9. The toggle wrench of claim 4 having said first elongated handle extending substantially in a direction at an obtuse angle with respect to said first compression surface.

10. The toggle wrench of claim 7 having said jaws each being disposed substantially in a plane, said planes being parallel at all times.

11. The toggle wrench of claim 4 having said jaws each being disposed substantially in a plane, said planes being parallel at all times.

12. The toggle wrench of claim 4 having said first elongated handle extending substantially in a direction at an obtuse angle with respect to said first compression surface, said obtuse angle being between 115° and 155°.

13. The toggle wrench of claim 4 having said first elongated handle extending substantially in a direction at an obtuse angle with respect to said first compression surface, said obtuse angle being substantially 45°.

* * * * *